United States Patent [19]

Tewsley et al.

[11] 4,055,058

[45] Oct. 25, 1977

[54] ELECTRONIC CONTROL DATA TRANSMISSION FOR KNITTING MACHINES

[75] Inventors: Eric William Tewsley, Kirby Muxloe; Ian Matthewman, Fleckney, both of England

[73] Assignee: Wildt Mellor Bromley Limited, England

[21] Appl. No.: 612,849

[22] Filed: Sept. 12, 1975

[30] Foreign Application Priority Data

Sept. 17, 1974 United Kingdom ..... 40577/74

[51] Int. Cl.[2] ..... D04B 15/78

[52] U.S. Cl. ..... 66/50 R; 66/154 A; 250/551

[58] Field of Search ..... 66/154 A, 75 A, 50 R, 66/14, 75.2; 250/551

[56] References Cited

U.S. PATENT DOCUMENTS

| | | | |
|---|---|---|---|
| 3,324,685 | 6/1967 | Schmidt | 66/154 A X |
| 3,480,783 | 10/1969 | Mankarious | 250/551 X |
| 3,760,610 | 9/1973 | Hadam et al. | 66/154 A |
| 3,766,755 | 10/1973 | Hadam et al. | 66/154 A |
| 3,783,642 | 1/1974 | Hadam et al. | 66/75 A |
| 3,807,196 | 4/1974 | Gottsching | 66/50 R |
| 3,809,908 | 5/1974 | Clanton | 250/551 |
| 3,831,402 | 8/1974 | Schuman | 66/50 R |
| 3,877,255 | 4/1975 | Allavena | 66/50 R X |
| 3,896,638 | 7/1975 | Gottschall et al. | 66/50 R |
| 3,972,207 | 7/1976 | Vinas | 66/50 R |

*Primary Examiner*—Mervin Stein
*Assistant Examiner*—Andrew M. Falik
*Attorney, Agent, or Firm*—Irving M. Weiner; Pamela S. Austin

[57] ABSTRACT

A knitting machine comprises a stationary part and a rotary part, a data transmitter associated with the stationary part and a data receiver associated with the rotary part. The rotary part carries a photo-receiver either on its axis of rotation or arranged to follow a predetermined path as the rotary part rotates, said photo-receiver being connected to the data receiver. The stationary part carries a photo-emitter or a configuration of photo-emitters located so as to illuminate the photo-receiver or the path of the photo-receiver, the photo-emitter or photo-emitter configuration being connected to the data transmitter to illuminate the photo-receiver or the path of the photo-receiver with a train of light pulses corresponding to the data transmitted so that the photo-receiver produces a train of electrical pulses corresponding to the data transmitted.

9 Claims, 9 Drawing Figures

ELECTRONIC CONTROL DATA TRANSMISSION FOR KNITTING MACHINES

This invention relates to knitting machines.

A modern trend in knitting machines is the use of electronic control, and for this purpose control data are transmitted to the machine in the form of trains of pulses. In some cases it happens that the mechanism to be controlled, e.g., a patterning mechanism, is mounted on a moving part of the machine and the trains of pulses then have to be transmitted, without corruption, from a stationary data transmitter, such as a computer, to the mechanism on the moving part.

A type of knitting machine which is particularly affected by this problem is that in which an electronically controlled patterning mechanism is mounted on a moving part of the knitting machine, i.e., principally machines in which the cam boxes and associated patterning units are made to revolve around a stationary needle cylinder. However, it is also known to mount a patterning unit within the wall of a revolving needle cylinder and the invention would of course be equally applicable to such machines.

It is conventional to employ slip rings and brushes to transmit electrical power or signals from a stationary body to a rotary body, but it has been found that such mechanical devices are insufficiently reliable to operate for long periods without the risk of corrupting the pulses required for the control of a knitting machine.

The present invention consists in a knitting machine comprising stationary and rotary parts and means for transmitting control data in the form of electrical signals to the rotary part, said transmitting means comprising a photo-receiver on the rotary part arranged to follow a predetermined circular path as the part rotates and a static photo-emitter configuration arranged to receive the control data from a data transmitter and to illuminate the path of the photo-receiver with a train of light pulses corresponding to the control data so that the photo-receiver produces a train of electrical pulses corresponding to the original control data and passes them to appropriate data receiving means or other rotary part.

In a limiting case, the photo-receiver may be mounted on the axis of rotation of the rotary part, so that it may be said to describe a circle of zero radius as the rotary part rotates. In such a case the photo-emitter configuration may consist of a single photo-emitter aligned with the photo-receiver.

In most applications, it will be necessary to transmit two trains of pulses to the rotary part, i.e. clock or synchronising pulses and data pulses, and normally two photo-emitter/receiver configurations will be required. Location on the axis of rotation does introduce severe design constraints, but it is feasible for both to be on the axis of rotation. Alternatively, one or both may be off the axis of rotation.

It will be appreciated that the terms photo-emitter and photo-receiver do not necessarily imply that the light pulses are in the visible part of the light spectrum, but that radiations just outside this spectrum may also be used.

The data transmitter may be of any type capable of transmitting electrical signals or pulses and although, in the following example, a computer control configuration is employed, other means such as magnetic tape or disc, perforated pattern tape and photo-optical devices may be used.

The data receiver on the knitting machine, i.e., the mechanism to be controlled, may be of any type which is constructed to operate electrically. Yarn feeder and trapper devices etc., may be operated through the medium of the transmission arrangement but it is particularly useful in transmitting operating pulses to the patterning units which influences the butts on or associated with the needles. Such units may be of the type which employ a magnet acting directly on the butts, or may be devices using intermediate actuators which are movable between inactive and active positions for influencing the butts. Included in the latter type are those in which the actuators are arranged in a stack, one above the other, for action on butts which are arranged in echelon formation and this is the type described in the present example.

In a preferred form the photo-emitter configuration consists of a circular array of individual photo-emitters adapted to be energized simultaneously so as to illuminate an annular zone containing the circular path of the photo-receiver.

In addition to the increase in functioning efficiency already mentioned, the invention also allows an increase in the patterning scope of machines of the type to which it is applicable. For instance, in a machine having a revolving cambox and revolving patterning units it has been normal to reset each patterning unit only once per revolution of the cambox, as the units pass by a common re-setting device. As the invention makes it possible to transmit data continuously to a rotary part, the common re-setting device may be dispensed with and the individual revolving patterning units may be re-set at the required frequency to enable every needle to be repositioned before every knitting station with which the machine is equipped.

The invention will be further described with reference to the accompanying drawings, which slow preferred embodiments of the invention, and in which.

Figures 1, 2:
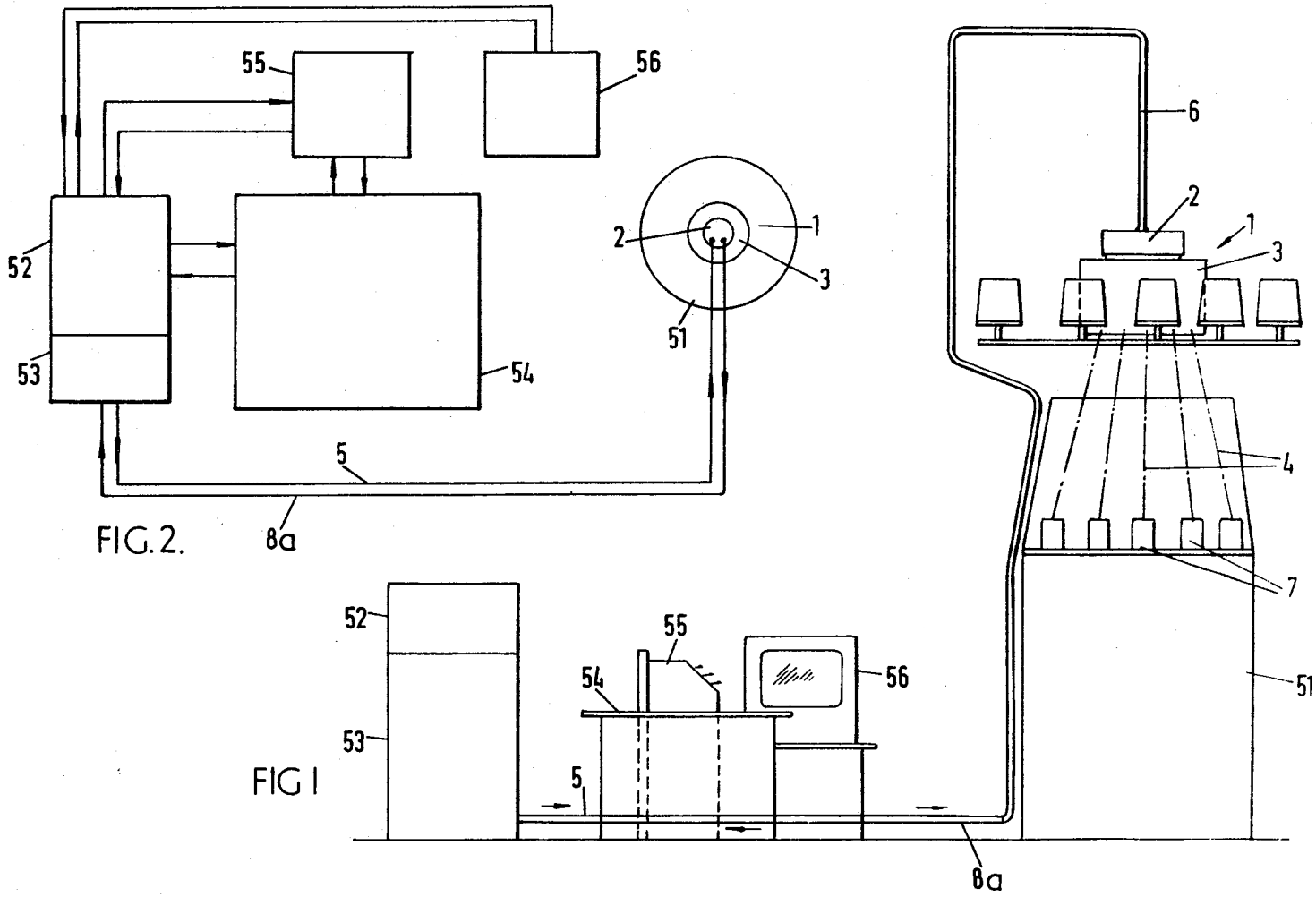
FIG. 1 is a diagrammatic view of a typical computer and pattern preparation configuration coupled to a knitting machine.
FIG. 2 is a diagrammatic plan view of the items in FIG. 1.

FIGS. 1 and 2 show diagrammatically a knitting machine 51 associated with a computer 52 through an interface 53. For pattern preparation there is also provided a digitizing table 54, a keyboard 55 and a visual display unit 56.

The knitting machine 51 taken by way of example has two superposed stationary needle cylinders with double-ended needles capable of being transferred between the cylinders for the manufacture of fabrics having rib and plain stitches. Revolving camboxes surround the cylinders, and mounted adjacent the camboxes and revolving with them are patterning units indicated in FIGS. 1 and 3 by numeral 7. Each unit 7 is connected by wiring to a revolving part 3 of a coupling unit indicated generally at 1 in FIGS. 1 and 3. The part 3 is rigidly attached by structure 3*a* to a cambox support ring CR which is caused to revolve in known manner by means not shown.

A non-revolving part 2 (FIGS. 1, 2 and 3) of the coupling unit is fixed to the upper end of a vertical post 11 which is supported by the stationary upper needle cylinder (not shown). Bearings 12 and 13 are provided to mount the revolving part 3 over the post 11.

A conduit tube 6 is provided to connect the coupler unit 1 to the computer interface 53 as shown in FIG. 1 and a cable 8*a* within the conduit tube 6 serves to connect the computer to a timing device 8 (FIG. 3) which is mounted within the stationary part 2 of the coupling unit 1. The timing device 8 is driven through a pinion 9 by a gear 10 attached to the revolving part 3 of the coupler unit 1. Thus, as the cambox and patterning units 7 revolve, timing pulses are transmitted by the device 8 to the computer. These pulses are in effect timed to the motion of the patterning units 7 around the needle cylinder so that, no matter what the speed of the knitting machine may be, the pulses will request patterning information to be sent from the computer at the correct time to suit the disposition of the patterning actuators in relation to the knitting butts.

A further composite cable 5 is housed within conduit tube 6 to transmit patterning data in a series of two differing types of signals (binary 1 or 0) from the computer to the coupler unit 1. The composite cable 5 also transmits a series of 'clock' pulses from the computer to the coupler unit 1, and the data signals and the 'clock' pulses mutually co-act to convey patterning impulses to the patterning units 7 via the coupler unit 1 in the following manner.

Figure 3:
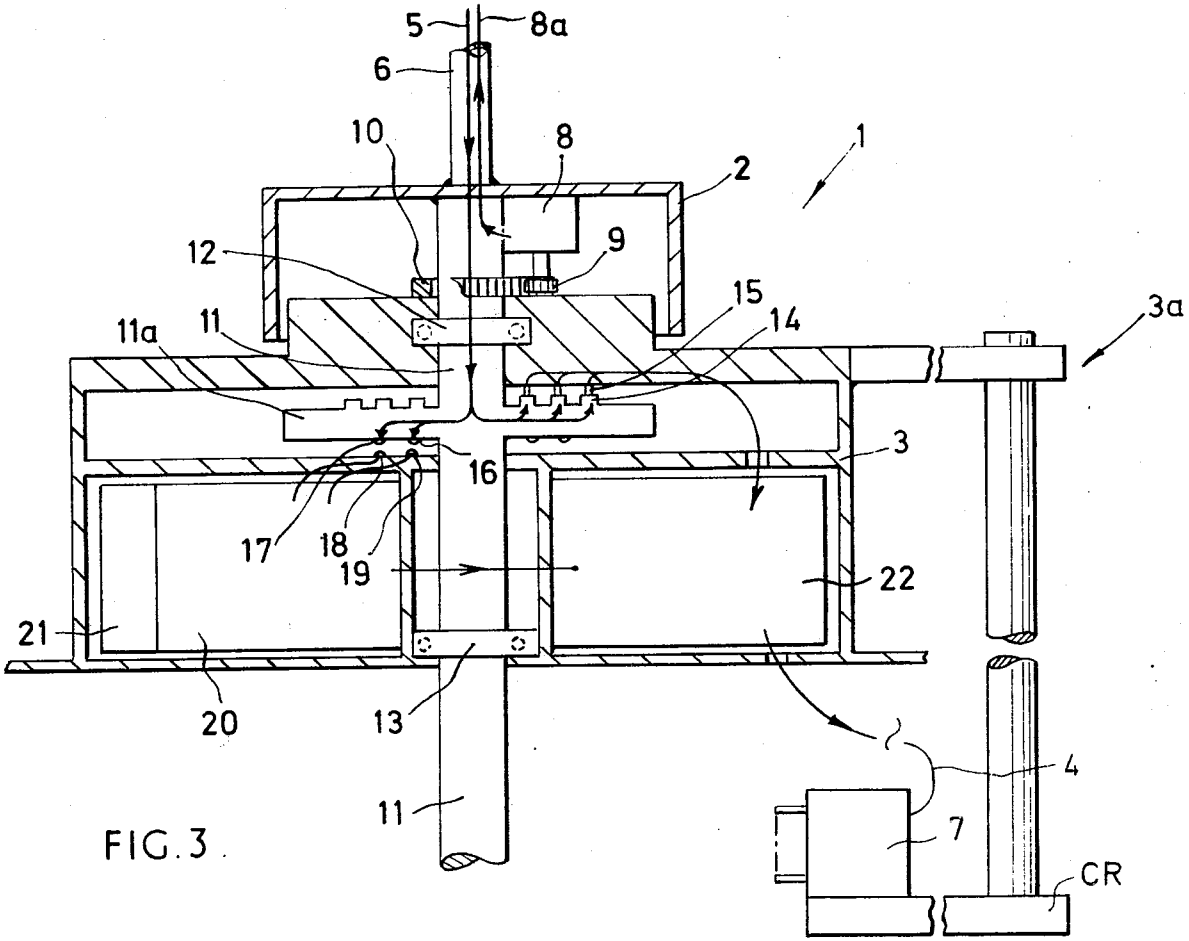
FIG. 3 shows a part sectional side elevation of the optical coupling unit according to the invention.
Figure 4:
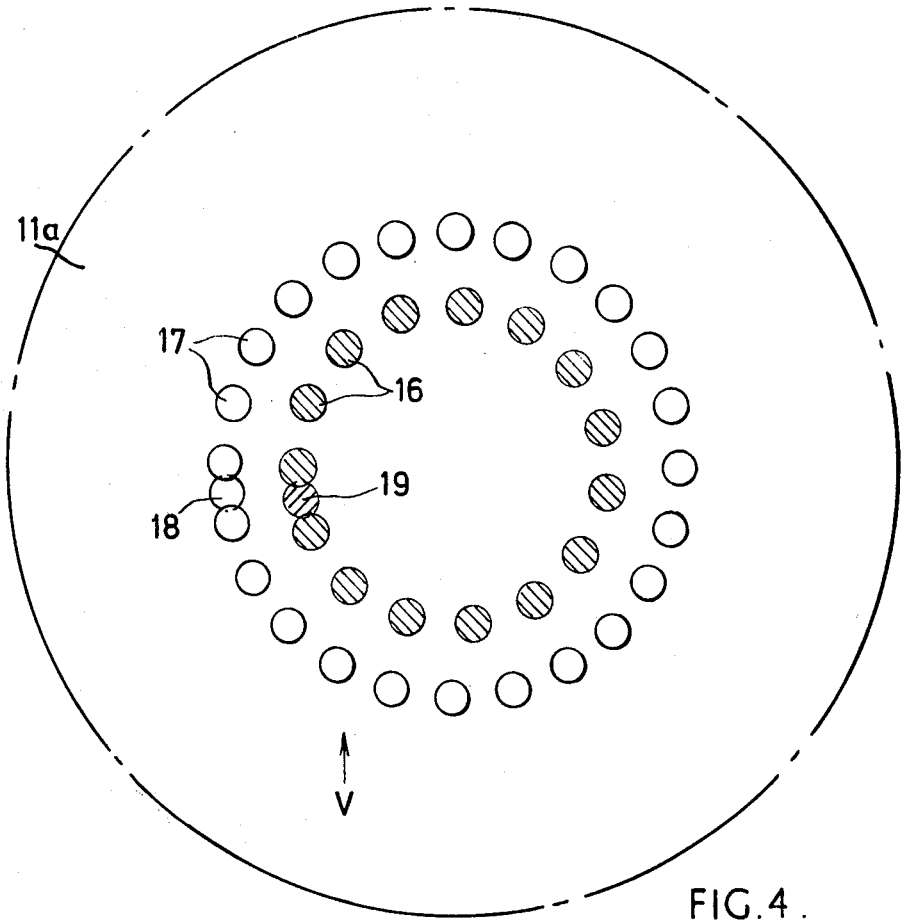
FIG. 4 is a diagrammatic enlarged plan view of part of the unit shown in FIG. 3.
Figure 5:
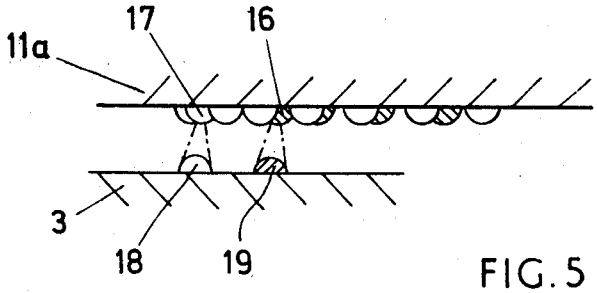
FIG. 5 is a scrap view showing the relationship between the photo-emitters and photo-receivers used in the coupling unit shown in FIG. 3.

The composite cable 5 enters the coupler unit 1 as shown in FIG. 3 through the conduit tube 6 into the upper end of mounting post 11 and terminates in a (stationary) disc 11*a* where its two leads are connected one to each of two circular series of photo-emitters 16 and 17 (see also FIGS. 4 and 5).

Arranged below, and in radial register with, each series of photo-emitters 16 and 17 are single photo-receivers 18 and 19 which are fixed to, and revolve with, part 3 of the coupler unit 1. The circumferential spacing of emitters 16 and 17 is close enough to ensure that a signal can be picked up by a receiver 18 or 19 even when the receiver is positioned mid-way between two emitters in the opposed relative circular series.

Pattern data signals from the computer are transmitted via emitters 17 and received by receiver 18 and 'clock' pulses from the computer are transmitted via emitters 16 and received by receiver 19.

By arranging that the complete circular series of photo-emitters 16 and 17 all transmit the same signal received from the computer, the single photo-receivers 18 or 19 will pick up that signal as they are revolving beneath the emitters and the arrangement will function in the manner of the aforementioned slip rings, brushes and contacts, bus-bars etc., without suffering the mechanical unreliability to which such devices are subjected.

If reference is made to FIG. 3 it can be seen that the revolving lower part 3 of the coupler unit 1, houses a serial/parallel converter board 20 together with an 'address' or pre-set routing device 21.

Also housed in the unit 1 are a number of selector driver boards 22 (amplifying circuits). Each of these boards is connected to a patterning unit 7. As the signals which are transmitted between parts 2 and 3 of the coupler 1 are extremely small, they have to be amplified in the selector driving boards 22 and electrical power has to be supplied to these boards. This is done as shown in FIG. 3. Power cables enter the coupler 1 through conduit 6 and post 11 e.g. as part of composite cable 5) into the stationary disc 11*a* and current is transmitted to the driver boards 22 (which are rotating together with part 3 of the coupler 1) via slip rings 14 and brushes 15.

The arrangement functions as follows:

As the cam box and actuator units 7 revolve around the stationary needle cylinders, timing or 'request' pulses are transmitted at needle frequency from the device 8 to the computer. Each pulse 'accesses' the memory of the computer causing a 'block' of data and 'clock' signals to be transmitted from the computer along the composite cable 5 in series form. Each 'block' of data signals is composed of discrete signals of two types termed logic 1 and logic 0. Logic 1 may be equal to 5 volts and logic 0 equal to 0 volts. Each discrete data signal activates, simultaneously, the circle of individual emitters 17 and therefore each signal is picked up by the receiver 18 as it rotates below the circle of emitters. In similar manner, each 'clock' signal activates the circle of individual emitters 16 and each signal is picked up by the receiver 19 as it rotates below the emitters. The data and clock signals are fed to the serial/parallel converter board 20 and the 'clock' signals act upon the data signals to enable correct separation of the logic 1 signals and logic 0 signals as they are temporarily stored in the converter board 20.

Sufficient signals are stored to influence one actuator of each patterning unit before a special clock signal causes release of the stored signals simultaneously whereupon they are routed by the address 21 through their respective amplifier boards 22 which (by using the current fed separately to them as hereinbefore mentioned) amplify the signals sufficiently to cause movement of an electromagnetically controlled actuator in each individual stack.

From the above it will be appreciated that, in the short time that the cambox and associated patterning units have moved around the needle cylinder the distance of one needle pitch, a signal has been sent from the knitting machine to the computer and on receipt of the signal the computer has transmitted, via the coupler unit, sufficient data and 'clock' signals to cause a needle selecting action by every patterning unit with which the machine is equipped.

Figure 6:
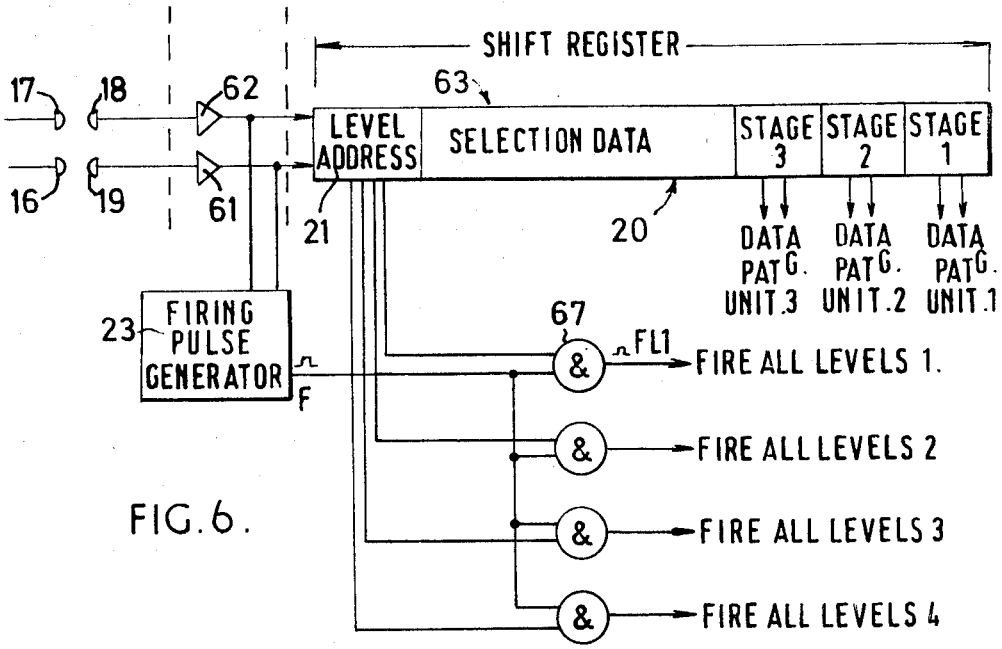
FIG. 6 is a block diagram illustrating the operation of part of the structure illustrated in FIG. 3.

FIG. 6 is a block diagram of the serial/parallel converter 20. The trains of data and clock pulses from the computer pass through the optical couplers constituted by the emitters 16, 17 and the receivers 18, 19 and through threshold detectors 61, 62. The same clock pulses enable the input data train to enter the shift register store 63. Since the number of clock pulses in a given train is chosen to be equal to the number of shift register stages, the selection data associated with each specific patterning unit is always stored in the same shift register stage (see FIG. 6). Similarly, the level address (where necessary) is always available from the shift register stages as shown. Obviously (in this example) only one actuator in each patterning unit is influenced during the transmission of each data block. Having transmitted a block of signals, the computer then transmits a special data signal and a special clock signal which are coincident in time. This logical condition is recognized by a firing pulse generator 23 which outputs a short firing pulse as shown at (F) in FIG. 6. By carrying out a logical AND operation at gates 67 using the pulse (F) and the level address information signal a firing pulse is generated e.g., FL1 as shown in FIG. 6. For the sake of completeness it should be stated that a common bistable device is incorporated in each stage of the shift register 63, by which means a logic 1 or logic 0 signal received in the stage gives a logic 1 signal on the corresponding data line or the inverse data line to be matched with the firing signal at an AND gate 64 or 65 respectively (FIG. 7) to cause positive or negative current flow through the coil.

Figure 7:
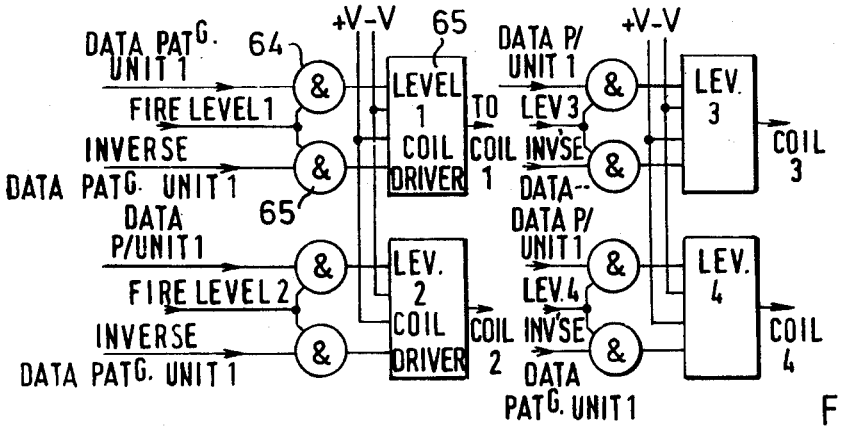
FIG. 7 is a block diagram illustrating the operation of another part of the structure illustrated in FIG. 3.

FIG. 7 shows an amplifier board for driving a patterning unit of the intermediate actuator lever type. In this case, two 'power' voltages +V and −V from the slip rings 14 are necessary such that the coil current from a coil driver 65 may be positive going or negative going depending on the presence of a logic 1 or logic 0 signal stored in stage 1.

Two logical AND operations are necessary at the input to each coil driver. FIG. 7 shows the selector driving board 22 for operating a single patterning unit having four actuators. If the number of actuators in a unit is reduced, then the circuitry will be omitted accordingly.

Figure 8:
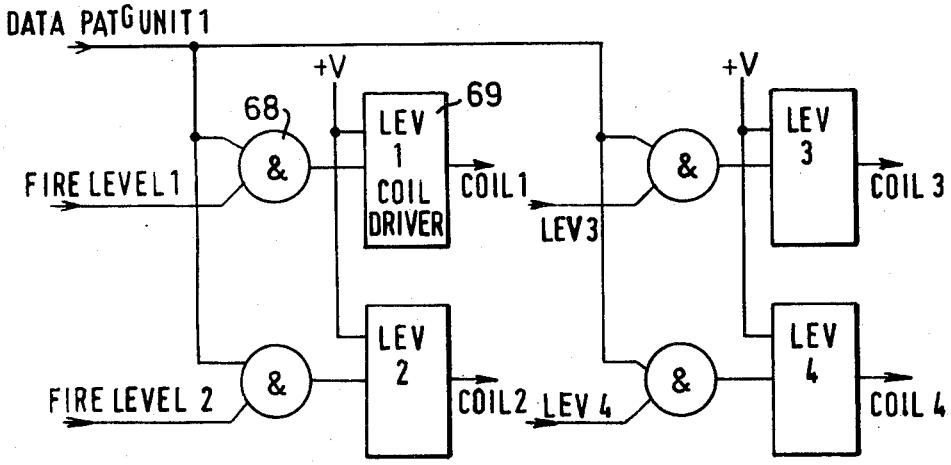
FIG. 8 is a block diagram illustrating the operation of an alternative form of the diagram of FIG. 7.

FIG. 8 shows an amplifier board to drive the type of patterning units in which a magnet acts directly on the butts. In this case, only one power voltage +V is required since a uni-directional current pulse is all that is necessary. In this case only one logical AND operation at gate 68 is necessary at the input to each coil driver 69. FIG. 8 shows the selector driving board 22 for operating a single patterning unit having four butt selector magnets and if the number of selector magnets is reduced, then the circuitry to the other magnets will be omitted.

Figure 9:
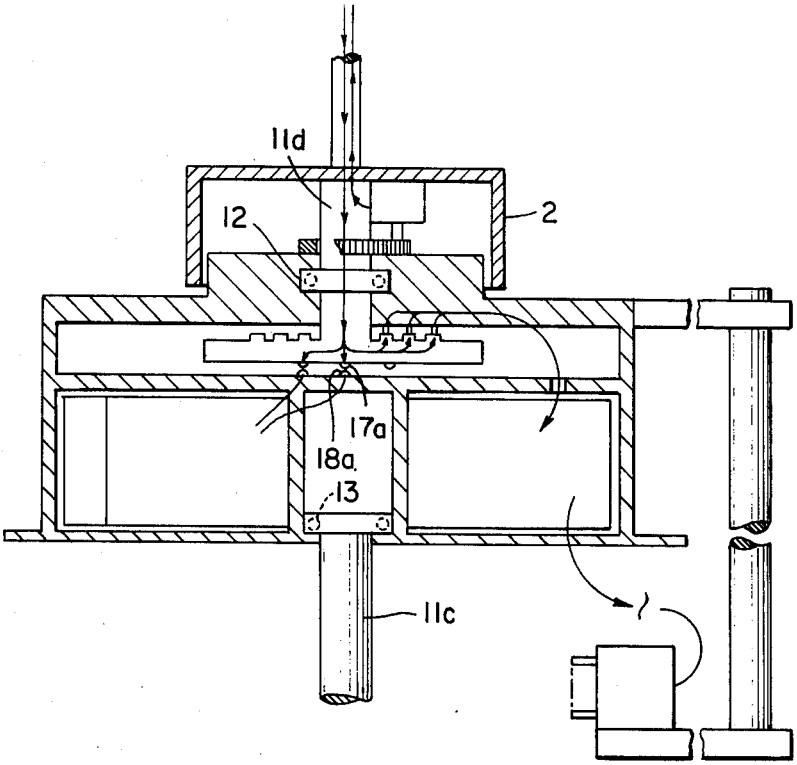
FIG. 9 shows a modified form of the structure shown in FIG. 3.

Turning now to FIG. 9, this is a view similar to FIG. 3, but in which the circular series of photo-emitters 17 is replaced by a single emitter 17*a* on the axis of rotation and co-operating with a photo-receiver 18*a* also located on the axis of rotation. To achieve this, the post 11 is in two parts 11*c* and 11*d* carrying the bearings 13 and 12 respectively. The disc 11*a* is on the part 11*d.*

Various modifications may be made within the scope of the invention.

We claim:

1. In a knitting machine comprising a stationary part and a rotary part, a data transmitter associated with the stationary part and a data receiver associated with the rotary part: the improvement that the rotary part carries a photo-receiver arranged to follow a predetermined path as the rotary part rotates, said photo-receiver being connected to the data receiver, and that the stationary part carries a configuration of photo-emitters, said photo-emitter configuration consisting of an array of individual photo-emitters adapted to be energized simultaneously so as to illuminate a zone containing the whole of the path of the photo-receiver, the photo-emitter configuration being connected to the data transmitter to illuminate the path of the photo-receiver with a train of light pulses corresponding to the data transmitted so that the photo-receiver produces a train of electrical pulses corresponding to the data transmitted.

2. A knitting machine as claimed in claim 1, in which the light pulses are in the visible part of the light spectrum.

3. In a knitting machine comprising a stationary part and a rotary part, a data transmitter associated with the stationary part and a data receiver associated with the rotary part: the improvement that the rotary part carries a photo-receiver arranged to follow a predetermined path as the rotary part rotates, said photo-receiver being connected to the data receiver, and that the stationary part carries a configuration of photo-emitters located so as to illuminate the whole of the path of the photo-receiver, the photo-emitter configuration being connected to the data transmitter to illuminate the path of the photo-receiver with a train of light pulses corresponding to the data transmitted so that the photo-receiver produces a train of electrical pulses corresponding to the data transmitted, in which the photo-emitter configuration consists of a circular array of individual photo-emitters adapted to be energized simultaneously so as to illuminate an annular zone containing the path of the photo-receiver, said photo-receiver being arranged to follow a circular path.

4. In a knitting machine comprising a stationary part and a rotary part, a data transmitter associated with the stationary part and a data receiver associated with the rotary part: the improvement that the rotary part carries a photo-receiver arranged to follow a predetermined path as the rotary part rotates, said photo-receiver being connected to the data receiver, and that the stationary part carries a configuration of photo-emitters located so as to illuminate the whole of the path of the photo-receiver, the photo-emitter configuration being connected to the data transmitter to illuminate the path of the photo-receiver with a train of light pulses corresponding to the data transmitted so that the photo-receiver produces a train of electrical pulses corresponding to the data transmitted, wherein the data to be transmitted consists of two trains of pulses, in which the movable part carries two photo-receivers each moving along a different predetermined path as the rotary part rotates, the stationary part having two configurations of photo-transmitters, one configuration being arranged to illuminate one of the two said paths.

5. In a knitting machine comprising a stationary part and a rotary part, a data transmitted associated with the stationary part and a data receiver associated with the rotary part: the improvement that the rotary part carries a photo-receiver arranged to follow a predetermined path as the rotary part rotates, said photo-receiver being connected to the data receiver, and that the stationary part carries a configuration of photo-emitters located so as to illuminate the whole of the path of the photo-receiver, the photo-emitter configuration being connected to the data transmitter to illuminate the path of the photo-receiver with a train of light pulses corresponding to the data transmitted so that the photo-receiver produces a train of electrical pulses corresponding to the data transmitted, wherein the data to be transmitted consists of two trains of pulses, in which the rotary part and the stationary part has a single photo-emitter adjacent with the said last mentioned photo-receiver, one train of pulses being transmitted between the single photo-emitter and the said last mentioned photo-receiver.

6. In a knitting machine comprising a stationary part and a rotary part, a data transmitter associated with the stationary part and a data receiver associated with the rotary part: the improvement that the rotary part carries a photo-receiver arranged to follow a predetermined path as the rotary part rotates, said photo-receiver being connected to the data receiver, and that the stationary part carries a configuration of photo-emitters located so as to illuminate the whole of the path of the photo-receiver, the photo-emitter configuration being connected to the data transmitter to illuminate the path of the photo-receiver with a train of light pulses corresponding to the data transmitted so that the photo-receiver produces a train of electrical pulses corresponding to the data transmitted, in which the rotary part also houses routing circuitry and amplifiers for the transmitted pulses, and comprising a plurality of electro-magnetic needle-selecting devices, and routing circuitry being arranged to apply the pulses received to the needle-selecting devices in a predetermined order.

7. A knitting machine as claimed in claim 6, in which the routing circuitry includes means for storing a portion of a train of pulses and releasing the pulses to the selectors simultaneously.

8. In a knitting machine comprising a stationary part and a movable part, a data transmitter associated with the stationary part, and a data receiver and a plurality of electro-magnetic needle-selecting devices associated with the movable part, the improvement that:

means are provided for transmitting a plurality of different signals through a common transmitter and receiver system to provide for operation of a plurality of needle actuators, said common transmitter and receiver system including:

a photo-receiver carried on said movable part and arranged to follow a predetermined path as the movable part follows its normal movement, said photo-receiver being connected to the data receiver;

a configuration of photo-emitters carried on the stationary part and located so as to illuminate the whole of the path of said photo-receiver, said photo-emitter configuration being connected to the data transmitter to illuminate the path of said photo-receiver with a train of light pulses corresponding to the data transmitted so that said photo-receiver produces a train of electrical pulses to the data receiver corresponding to the data transmitted;

said photo-emitter configuration and said photo-receiver cooperating to comprise a transmitter and receiver optical coupling system;

only two of said transmitter and receiver optical coupling systems are provided for operation of any number of said needle-selecting devices;

and the data receiver including routing circuitry for applying the pulses to the needle-selecting devices in a predetermined order.

9. In a knitting machine comprising a stationary part and a movable part, a data transmitter associated with the stationary part, and a data receiver and a plurality of electro-magnetic needle-selecting devices associated with the movable part: the improvement that the movable part carries a photo-receiver arranged to follow a predetermined path as the movable part follows its normal movement, said photo-receiver being connected to the data receiver, and that the stationary part carries a configuration of photo-emitters located so as to illuminate the whole of the path of the photo-receiver, the photo-emitter configuration being connected to the data transmitter to illuminate the path of the photo-receiver with a train of light pulses corresponding to the data transmitted so that the photo-receiver produces a train of electrical pulses to the data receiver corresponding to the data transmitted, and the data receiver including routing circuitry for applying the pulses to the needle-selecting devices in a predetermined order, in which the routing circuitry includes means for storing a portion of a train of pulses and releasing the pulses to the selectors simultaneously.

* * * * *